US007464678B2

(12) United States Patent
Rozario et al.

(10) Patent No.: US 7,464,678 B2
(45) Date of Patent: Dec. 16, 2008

(54) HYDRAULIC LASH ADJUSTER

(75) Inventors: Frederick J. Rozario, Fenton, MI (US); Mark Stabinsky, Troy, MI (US); William C. Albertson, Clinton Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/675,169

(22) Filed: Feb. 15, 2007

(65) Prior Publication Data

US 2008/0196684 A1 Aug. 21, 2008

(51) Int. Cl.
*F01L 1/14* (2006.01)

(52) U.S. Cl. ..... 123/90.52; 123/90.55; 123/90.56

(58) Field of Classification Search ..... 123/90.52, 123/90.48, 90.55, 90.56; 74/569
See application file for complete search history.

(56) References Cited

U.S. PATENT DOCUMENTS 6,460,499 B1 * 10/2002 Mason et al. ..... 123/90.55

* cited by examiner

*Primary Examiner*—Zelalem Eshete

(57) ABSTRACT

A hydraulic lash adjuster includes a cylindrical body having a central cylindrical bore. A hollow plunger is reciprocable in the bore and includes a reservoir chamber therein. The plunger has a close clearance with the bore. A high pressure chamber is defined by the plunger and a closed end of the bore. An orificed wall of the plunger separates the reservoir chamber from the high pressure chamber. A check valve is disposed in the orifice for allowing one-way flow of oil from the reservoir chamber to the high pressure chamber. A plunger spring disposed in the high pressure chamber urges the plunger away from the closed end of the bore. A seat is disposed at an end of the plunger distal from the high pressure chamber. The plunger includes a circumferential groove proximate the seat for holding oil to maintain an oil seal in the clearance to limit leakage of air through the clearance.

14 Claims, 5 Drawing Sheets

HYDRAULIC LASH ADJUSTER

TECHNICAL FIELD

This invention relates to hydraulic lash adjusters for internal combustion engines, and more particularly to an improved hydraulic lash adjuster.

BACKGROUND OF THE INVENTION

It is known in the art relating to hydraulic lash adjusters that lash adjusters undergo "leak-down" as part of their lash controlling function. "Leak-down" refers to a reduction in oil volume in a high-pressure chamber of the lash adjuster due to the downward stroke of the lash adjuster's plunger in reaction to a valve spring force of an associated cylinder valve. Hydraulic lash adjuster leak-down occurs through a calibrated clearance between a plunger and a guiding bore in the lash adjuster body.

In a multi-cylinder engine, when the engine is stopped, one or more of the cylinder valves are parked on the lift portions, or lobes, of their respective cams. These positions cause the valve springs to be compressed, providing reaction forces that result in lash adjuster leak-down.

After the engine has been shut off for a period of time, the engine oil galleries that feed oil to the hydraulic lash adjusters will drain and draw in air, often leaving an upper portion of the lash adjuster plunger exposed to air. Further, upon cooling of the engine while not running, the pressure in the high-pressure chamber will slowly become lower than atmospheric pressure due to the contraction of oil in the chamber. The slow contraction of the oil in the high-pressure chamber is not enough to open a check valve of the lash adjuster that is disposed between the high-pressure chamber and a reservoir chamber. The slow contraction of the oil, however, is sufficient to draw oil into the high-pressure chamber from the clearance between the plunger and the bore. In some valvetrain designs, there is not a sufficient supply of oil at the top portion of the clearance between the plunger and the bore to prevent air from also entering the clearance.

Upon restarting the engine, the cylinder valves will move from the cam lobes to the base circle, and the associated hydraulic lash adjusters will stroke upward to remove the lash that was produced during the lash adjuster leak-down. The upward stroke of the hydraulic lash adjuster plunger is brought about by the force of a plunger spring. This return stroke of the plunger at restart takes place rapidly and results in a significantly lowered pressure in the high-pressure chamber. Since at this point the oil film between the plunger and the bore is often fragmented or no longer exists, the easiest flow path into the high-pressure chamber is that of air through the clearance. Air in the high-pressure chamber of the lash adjuster then results in inadequate lash adjustment that produces an audible valvetrain noise. This condition remains until the air is purged from the high-pressure chamber, usually in a path back through the plunger to bore clearance.

SUMMARY OF THE INVENTION

The present invention provides an improved hydraulic lash adjuster that prevents the ingestion of air through the bore/plunger clearance into the high-pressure chamber. The improved hydraulic lash adjuster includes a seal arrangement at the bore/plunger clearance that prevents air leakage into the high-pressure chamber through the bore/plunger clearance while allowing oil flow out of the high-pressure chamber through the clearance as is necessary for proper lash adjuster leak-down. The present invention is also directed at maintaining a flow path that runs from the reservoir chamber through the check valve into the high-pressure chamber and out of the high-pressure chamber through the bore/plunger clearance, but not the opposite direction.

In an exemplary embodiment, a hydraulic lash adjuster in accordance with the present invention includes a cylindrical body having an annular oil groove for receiving oil from an oil gallery of an engine. The body includes a central cylindrical bore and a first oil inlet passage through a wall of the body into the bore. A hollow plunger is reciprocable in the bore and has a reservoir chamber therein. A second oil inlet passage passes through a wall of the plunger into the reservoir chamber.

A high pressure chamber is defined by the plunger and a closed end of the bore. An orificed wall of the plunger separates the reservoir chamber from the high pressure chamber. A check valve is disposed in the orifice and allows oil flow through the orifice from the reservoir chamber to the high pressure chamber while preventing oil flow from the high pressure chamber to the reservoir chamber. A check valve spring holds the check valve closed until reservoir oil pressure exceeds that in the high pressure chamber.

A plunger spring is disposed in the high pressure chamber. The plunger spring urges the plunger away from the closed end of the bore. In accordance with the invention, the plunger further includes a circumferential groove between the second oil inlet passage and an end of the plunger distal from the high pressure chamber for preventing leakage of air through the calibrated clearance into the high pressure chamber.

In a specific embodiment, the circumferential groove is configured to maintain a small reservoir of oil in the upper portion of the clearance to maintain an oil seal and prevent the passage of air downward through the clearance.

In another embodiment of the present invention, the lash adjuster includes a seal ring disposed in the groove. The seal ring may be an expandable ring that is expanded by upward plunger motion (lash take-up) or downward oil pressure to seal the clearance and that contracts to open the clearance. The ring may be metal or plastic with a small gap.

In yet another embodiment, the lash adjuster may include an elastomeric seal disposed in the groove and cammed or biased for one-way flow.

These and other features and advantages of the invention will be more fully understood from the following description of certain specific embodiments of the invention taken together with the accompanying drawings.

DESCRIPTION OF AN EXEMPLARY EMBODIMENT

Figure 1:
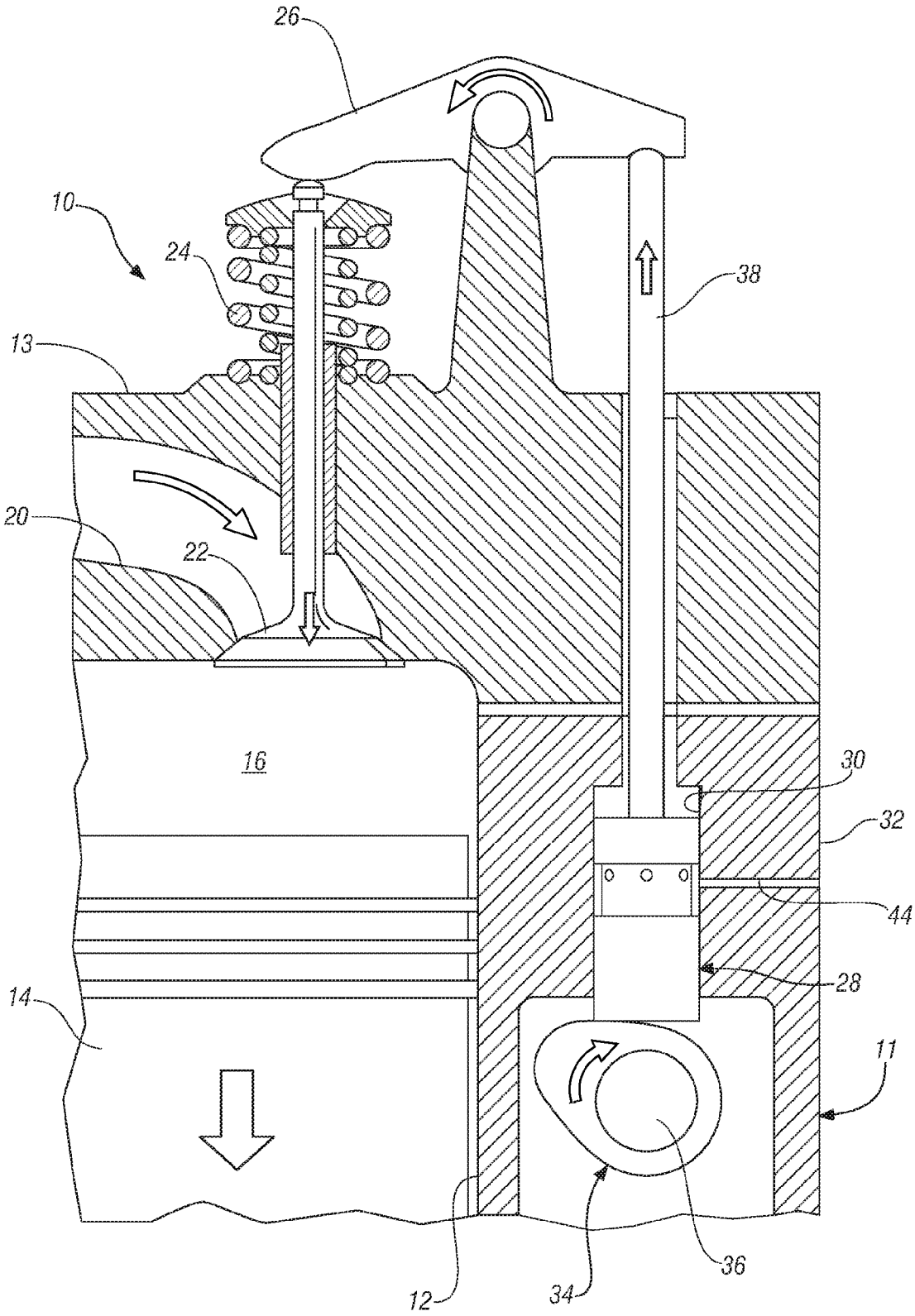
FIG. 1 is a schematic view of an internal combustion engine including a valvetrain with a hydraulic lash adjuster in accordance with the present invention.

Referring first to FIG. 1 of the drawings in detail, numeral 10 generally indicates, for example, an internal combustion engine including a cylinder block 11 having at least one cylinder 12 closed at one end by a cylinder head 13. A piston 14 is reciprocable in each cylinder 12 and together with the cylinder head 13 they define a variable volume combustion chamber 16. The cylinder head 13 includes cylinder intake ports 20 and exhaust ports (not shown) in communication with each cylinder 12. For purposes of example, the following discussion will refer to the intake ports (and intake valves), but it should be understood that the discussion applies equally to the exhaust ports (and exhaust valves).

Each cylinder intake port 20 is controlled by an intake valve 22 biased by a valve spring 24 and mounted in the cylinder head 13. Valve actuating mechanism including an intake rocker arm 26 engages the intake valve 22 and is pivotally mounted to the cylinder head 13. A valve lifter 28 is reciprocably disposed in a bore 30 of an engine lifter gallery 32 of the engine 10. An intake cam 34 mounted on a camshaft 36 mechanically actuates each intake valve 22 by reciprocating the lifter 28 to pivot the intake rocker arm 26 through, for example, a push rod 38.

Figure 2:
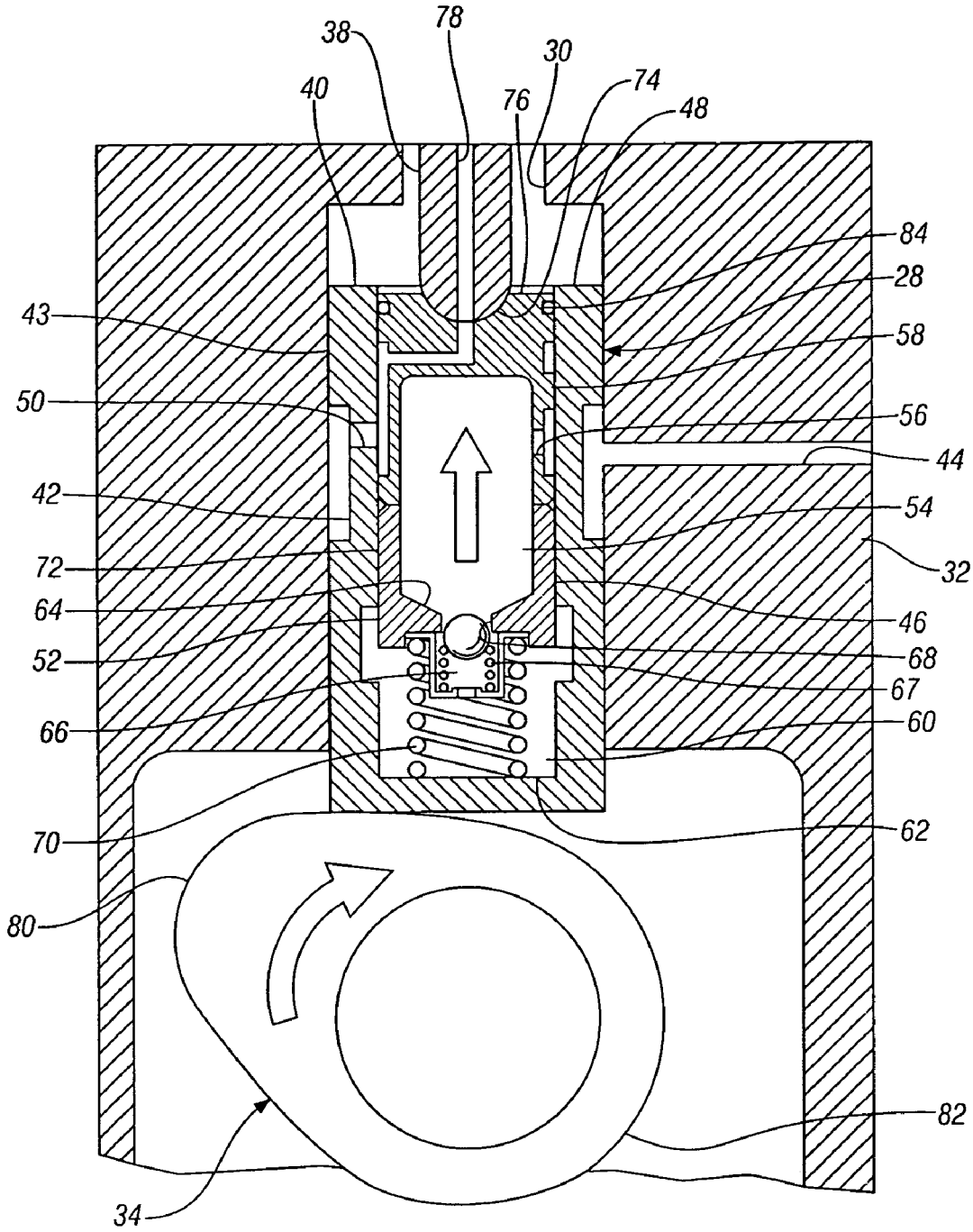
FIG. 2 is a cross-sectional view of the hydraulic lash adjuster of FIG. 1.

The valve lifter 28 is a hydraulic lash adjusting type valve lifter herein generally referred to as a hydraulic lash adjuster. As illustrated in FIG. 2, the hydraulic lash adjuster 28 includes an elongated generally cylindrical body 40 having an exterior annular oil groove 42 in a side wall 43 thereof. The annular oil groove 42 receives engine oil from an oil gallery 44 connected to the pressure side of an engine oil lubricating system and communicating with the lifter gallery bore 30. The cylindrical body 40 also includes a central cylindrical bore 46 therein having an open end 48. A first oil inlet passage 50 extends through the side wall 43 of the body 40 into the bore 46 to allow for flow of oil from the annular oil groove 42 into the bore.

A hollow plunger 52 is received into the bore 46 through the open end 48 and is reciprocable in the bore. The plunger 52 has an internal reservoir chamber 54 into which oil is delivered from the bore 46 via a second oil inlet passage 56 extending through a side wall 58 of the plunger 52. A high pressure chamber 60 is defined by the plunger 52 and a closed end 62 of the bore 46. An orificed wall 64 of the plunger 52 separates the reservoir chamber 54 from the high pressure chamber 60. A check valve 66, such as a caged check ball type check valve biased closed by a check ball spring 67, allows for one-way flow of oil from the reservoir chamber 54 through the orifice 68 of the orificed wall 64 to the high pressure chamber 60, but prevents oil flow from the high pressure chamber 60 back into the reservoir chamber 54. A plunger spring 70 or other similarly suitable resilient member is disposed in the high pressure chamber 60 and urges the plunger 52 away from the closed end 62 of the bore 46 towards the open end 48 of the bore. A calibrated, close clearance 72 between the plunger 52 and the bore 46 allows for controlled leakage of oil from the high pressure chamber 60. This leakage of oil through the narrow clearance 72 is commonly referred to as hydraulic lash adjuster leak-down and is necessary for proper lash control as described in more detail below.

The hydraulic lash adjuster 28 may also include a seat 74 disposed at an end 76 of the plunger 52 distal from the high pressure chamber 60. The seat 74 may be an orificed push rod seat in fluid communication with the first oil inlet passage 50 and also in fluid communication with an oil passage 78 in the push rod 38 for delivering oil to the valve actuating mechanism. Alternatively, the seat 74 may be a finger follower seat or other seat cooperable with the type of valve actuating mechanism used in the engine.

With respect to a specific cylinder 12 of the engine 10, during engine operation the camshaft 36 rotates the intake cam 34. As a lobe 80 of the cam 34 rotates against the hydraulic lash adjuster 28, the hydraulic lash adjuster is moved generally upwards. The upward movement of the lash adjuster 28 raises the push rod 38, which in turn pivots the rocker arm 26 to actuate the intake valve 22 into an open position. During valve actuation, the plunger 52 of the hydraulic lash adjuster 28 moves downward/inward relative to the body 40 (i.e., the plunger 52 moves towards the closed end 62) in reaction to the counterforce of the valve spring 24. This causes lash adjuster leak-down. The amount of oil that leaks through the clearance 72 is calibrated for proper engine operation.

As the camshaft 36 then further rotates the intake cam lobe 34, the lash adjuster 28 moves to a base circle portion 82 of the cam lobe. The lash adjuster 28 consequently moves generally downwards, which then lowers the push rod 38 and pivots the rocker arm 26, allowing the valve spring 24 to return the intake valve 22 to a closed position. After valve closing, the plunger spring 70 urges the plunger 52 of the lash adjuster 28 upward/outward relative to the body 40 to take up valve lash. This causes opening of the check valve 66 to draw oil into the high pressure chamber 60 from the reservoir chamber 54.

During periods of non-use when the engine 10 has been stopped for an extended period of time, the oil galleries that feed the lash adjuster 28 drain and are refilled with air. In some engines, this exposes the upper, distal end 76 of the plunger 52 to air. Further, upon engine cooling during a period of engine non-use, the pressure in the high pressure chamber 60 will slowly become lower than atmospheric pressure due to the contraction of oil in the chamber 60. The slow contraction of oil in the high pressure chamber 60 is not significant enough to open the check valve 66 but does cause oil to be drawn from the clearance 72 into the high pressure chamber 60, further exposing the plunger to air.

Figure 3:
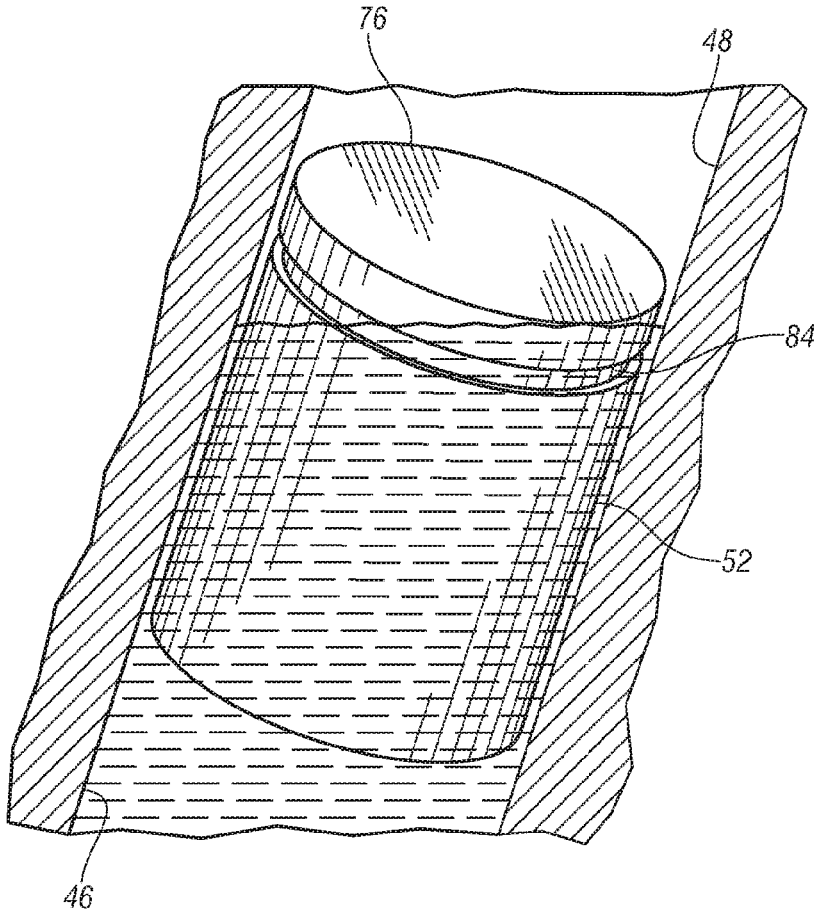
FIG. 3 is a pictorial view of a plunger in the hydraulic lash adjuster.
Figure 4:
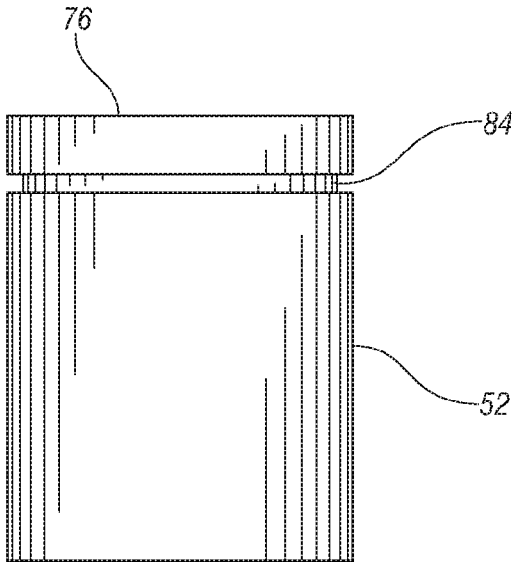
FIG. 4 is a schematic view of the plunger of FIG. 3.
Figure 5:
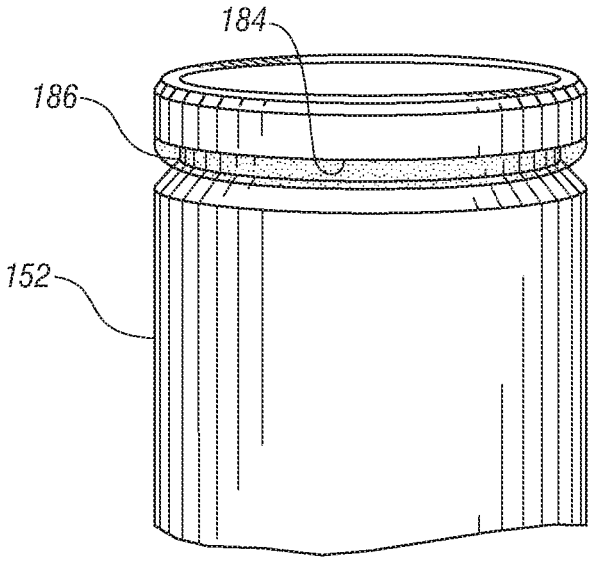
FIG. 5 is a pictorial view of an alternative embodiment of hydraulic lash adjuster plunger having a seal ring in a circumferential groove.

With reference now to FIGS. 2 through 4, the present invention provides a circumferential external groove 84 around the side wall 58 of the plunger 52, between the second oil inlet passage 56 and the distal end 76 of the plunger. The groove 84 is configured to restrict the passage of air through the plunger to body clearance 72 into the reservoir chamber 54. In a first embodiment, the circumferential groove 84 functions as a small reservoir that holds oil to maintain an oil seal in the clearance 72 that prevents flow of air into the high pressure chamber 60 through the clearance 72. The oil is held in the groove 84 by the oil's natural adhesion to metal and by the surface tension of the oil.

During engine off periods, the oil in the groove 84 is a source of oil to maintain the clearance seal when the distal end 76 portion of the plunger 52 is exposed to air (see for example FIG. 3). This prevents air from entering the high pressure chamber 60 during non-use of the engine. Further, upon cranking the engine, the oil in the groove 84 provides a seal in the clearance 72 to assure that when the plunger 52 moves upward/outward, expanding the high pressure chamber 60, oil flows from the reservoir chamber 54 into the high pressure chamber rather than air flowing into the high pressure chamber through the clearance 72. This is desirable since the presence of air in the high pressure chamber 60 may result in inadequate lash adjustment and consequently audible engine noise. The present invention helps to insure that all fluid flow travels from the reservoir chamber 54 into the high pressure chamber 60 and out through the clearance 72, and that fluid, especially air, does not flow through the clearance into the high pressure chamber.

Turning to FIGS. 5 through 7B, in a second embodiment of the present invention, a seal ring 186 such as an expandable type ring may be disposed in the circumferential groove 184. The seal ring 186 may be metal or plastic with a small gap, or may be made of a flexible, elastomeric material. Generally, the seal ring 186 expands to seal the clearance 172 and naturally contracts to open the clearance 172. More specifically, the seal ring 186 and/or the circumferential groove 184 are shaped such that the seal ring 186 expands when the plunger 152 moves upward/outward for lash take up, the seal ring 186 thereby providing a seal that prevents air from being drawn into the high pressure chamber 160 through the clearance 172. Further, the seal ring 186 contracts when the plunger 152 moves downward/inward to allow an open path in the clearance 172 for proper lash adjuster leak-down.

Figure 6A:
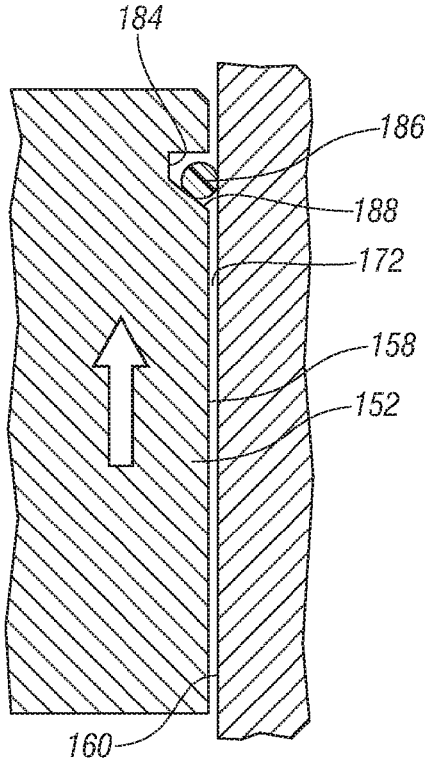
FIGS. 6A and 6B are schematic views of the plunger of FIG. 5 showing expansion and contraction of an elastomeric "O-ring" seal in the groove.
Figure 6B:
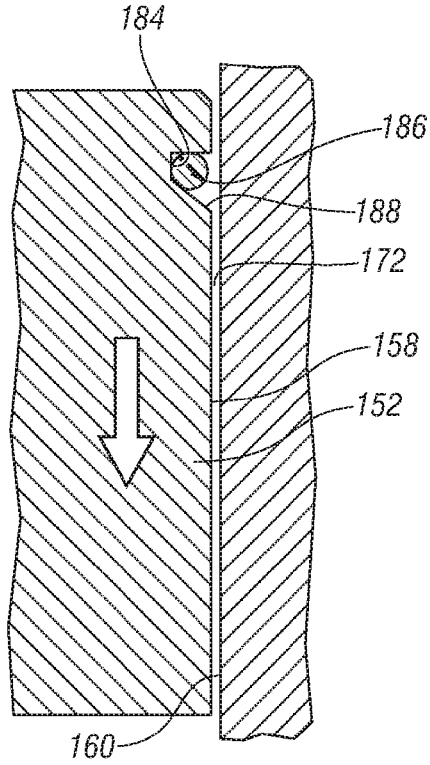
Figure 7A:
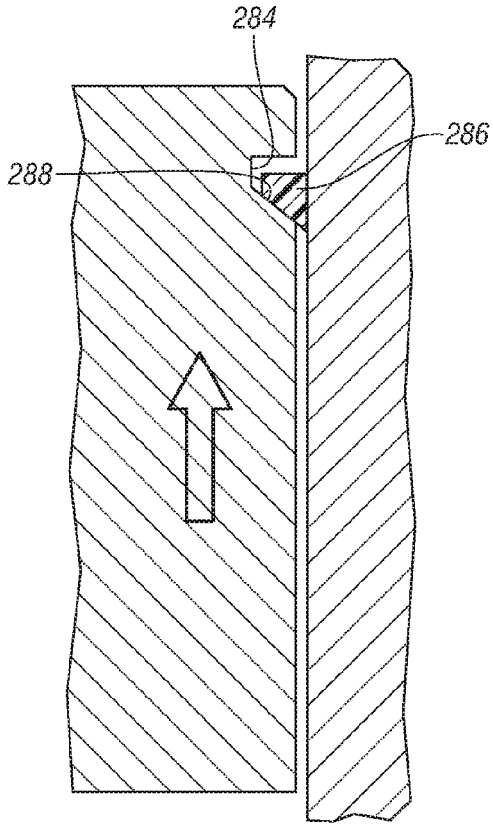
FIGS. 7A and 7B are schematic views of a plunger having a gap type seal ring in a circumferential groove.
Figure 7B:
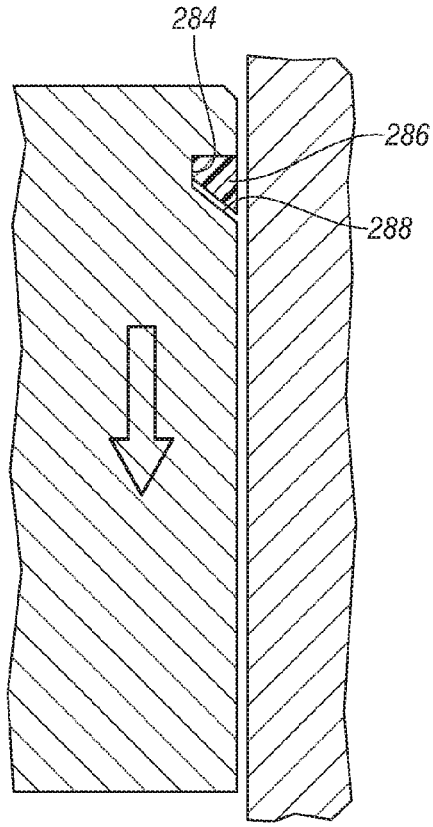

In this embodiment, the groove 184 may include a cammed surface 188 that aids in expanding the seal ring 186 during upward plunger movement and in contracting the seal ring 186 during downward plunger movement. As shown in FIGS. 6A and 6B, the cammed surface 188 may be inclined relative to the plunger wall 158 at an angle other than a 90 degree angle. The seal ring 186 may have a generally circular cross-section. Alternatively, as shown in FIGS. 7A and 7B, the seal ring 286 may have a trapezoidal cross-section wherein one face is not parallel to an opposite face. The non-parallel face may be angled at the same angle as the cammed surface 288 of the groove 284 such that the seal ring 286 smoothly and easily slides along the cammed surface 288.

Figure 8:
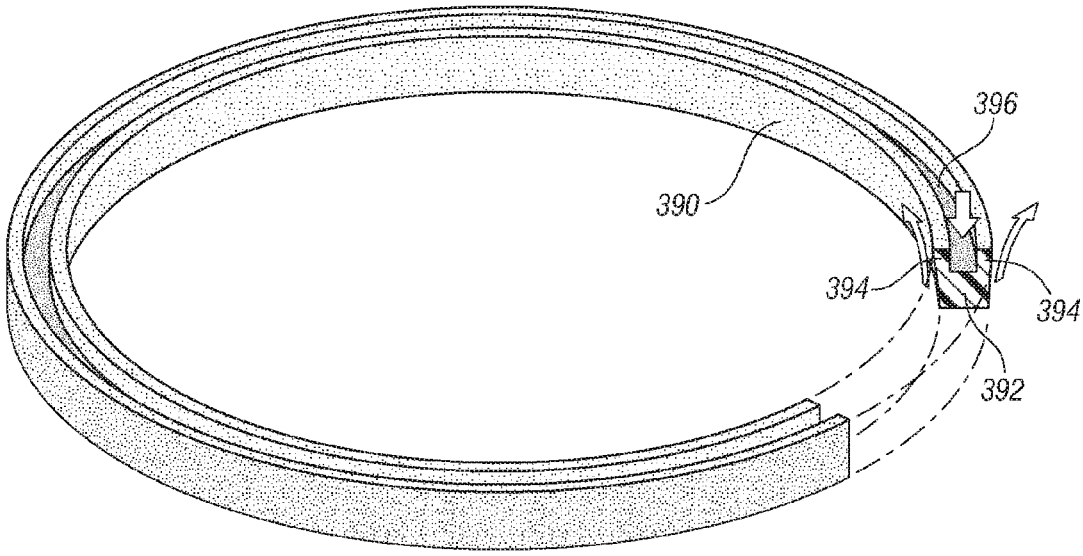
FIG. 8 is a pictorial view of yet another embodiment of a U-shaped elastomeric seal disposable in a plunger groove of a hydraulic lash adjuster.

Turning to FIG. 8, in a third embodiment of the present invention, an elastomeric U-shaped seal 390 may be disposed in the circumferential groove of the plunger. The seal 390 is designed to provide a good seal in one flow direction, preventing flow in that direction, while allowing flow in an opposite flow direction. In this embodiment, the elastomeric seal 390 is arranged in the groove such that it prevents flow through the clearance in the direction of the high pressure chamber to prevent the flow of air into the high pressure chamber. The seal 390, however, allows flow out of the high pressure chamber through the clearance for proper lash adjuster leak-down. The sealing and flow directions are schematically illustrated by arrows in FIG. 8.

In the embodiment shown, the seal 390 generally has a U-shaped cross-section that includes a base 392 and two legs 394 extending from ends of a side of the base 392. A slot 396 is defined between the legs 394 and the side of the base 392. Fluid flow that approaches the slot 396 side of the seal 390 urges the legs 394 outward to form a seal that prevents flow past the seal 390. Fluid flow that approaches the base 392 side of the seal 390 pushes the legs 394 inward towards the slot 396 to allow flow past the seal 390. It should be understood, however, that other cross-sectional shapes of elastomeric seals are within the scope of the present invention so long as they generally are capable of performing the same function as the seal 390.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. 1. A hydraulic lash adjuster comprising:

a cylindrical body having an annular oil groove for receiving oil from an oil gallery of an engine;

a central cylindrical bore in the body and having a closed end;

a first oil inlet passage through a side wall of the body into the bore;

a hollow plunger reciprocable in the bore and having a reservoir chamber therein;

a second oil inlet passage through a side wall of the plunger into the reservoir chamber;

a high pressure chamber defined by the plunger and the closed end of the bore, the plunger having a close clearance with the bore to limit leakage of oil from the high pressure chamber;

a second wall of the plunger separating the reservoir chamber from the high pressure chamber, the second wall including an orifice controlled by a check valve operative to allow oil flow through the orifice from the reservoir chamber to the high pressure chamber and to prevent oil flow from the high pressure chamber to the reservoir chamber;

a plunger spring disposed in the high pressure chamber urging the plunger away from the closed end of the bore to draw oil into the high pressure chamber when unloaded; and a circumferential external groove around the side wall of the plunger between the second oil inlet passage and an end of the plunger distal from the high pressure chamber, the groove configured to restrict the passage of air through the plunger to body clearance into the reservoir chamber.

2. The hydraulic lash adjuster of claim 1 wherein the circumferential groove holds oil for maintaining an oil seal in the clearance to prevent passage of air through the clearance.

3. The hydraulic lash adjuster of claim 1 wherein a seal ring is disposed in the groove.

4. The hydraulic lash adjuster of claim 3 wherein the seal ring is an expandable ring.

5. The hydraulic lash adjuster of claim 4 wherein the seal ring is expandable to seal the clearance and contracts to open the clearance.

6. The hydraulic lash adjuster of claim 3 wherein the seal ring is an elastomeric seal.

7. The hydraulic lash adjuster of claim 1 including an orificed push rod seat disposed at the end of the plunger distal from the high pressure chamber, the orificed push rod seat being in fluid communication with the first oil inlet passage.

8. A hydraulic lash adjuster comprising:

a cylindrical body having a central cylindrical bore, the cylindrical bore having a closed end;

a first oil inlet passage through a side wall of the body into the bore;

a hollow plunger reciprocable in the bore and having a reservoir chamber therein;

a second oil inlet passage through a side wall of the plunger into the reservoir chamber;

a high pressure chamber defined by the plunger and the closed end of the bore, the plunger having a close clearance with the bore to limit leakage of oil from the high pressure chamber;

a plunger wall having an orifice separating the reservoir chamber from the high pressure chamber;

a check valve operative to allow flow of oil through the orifice from the reservoir chamber to the high pressure chamber and to prevent flow of oil from the high pressure chamber to the reservoir chamber;

a plunger spring disposed in the high pressure chamber urging the plunger away from the closed end of the bore;

the plunger having an end distal from the high pressure chamber; and a circumferential external groove around the plunger proximate the plunger distal end and spaced between the first and second oil inlet passages and the plunger distal end, the circumferential groove configured to hold oil for maintaining an oil seal in the clearance to prevent passage of air through the clearance.

9. The hydraulic lash adjuster of claim 8 wherein the plunger has a push rod seat at said distal end.

10. A hydraulic lash adjuster comprising:

a cylindrical body having a central cylindrical bore, the cylindrical bore having a closed end;

a hollow plunger reciprocable in the bore and having a reservoir chamber therein;

a high pressure chamber defined by the plunger and the closed end of the bore, the plunger having a close clearance with the bore to limit leakage of oil from the high pressure chamber;

a plunger wall having an orifice separating the reservoir chamber from the high pressure chamber;

a check valve to allow flow of oil through the orifice from the reservoir chamber to the high pressure chamber and to prevent flow of oil from the high pressure chamber to the reservoir chamber;

plunger spring disposed in the high pressure chamber urging the plunger away from the closed end of the bore;

a seat disposed at an end of the plunger distal from the high pressure chamber;

a circumferential external groove around the plunger proximate the seat; and a seal ring disposed in the groove for temporarily sealing the clearance.

11. The hydraulic lash adjuster of claim 10 wherein the seal ring is an expandable ring that is expanded to seal the clearance and contracts to open the clearance.

12. The hydraulic lash adjuster of claim 10 wherein the seal ring is an elastomeric seal.

13. The hydraulic lash adjuster of claim 10 wherein the circumferential groove includes a cam face.

14. The hydraulic lash adjuster of claim 10 wherein the seat is a push rod seat.

* * * * *